US008963973B2

(12) United States Patent
Imamiya

(10) Patent No.: US 8,963,973 B2
(45) Date of Patent: Feb. 24, 2015

(54) IMAGE FORMING APPARATUS AND IMAGE FORMING METHOD

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Koji Imamiya, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/228,381

(22) Filed: Mar. 28, 2014

(65) Prior Publication Data

US 2014/0333706 A1 Nov. 13, 2014

(30) Foreign Application Priority Data

May 7, 2013 (JP) ..... 2013-097756

(51) Int. Cl.
*B41J 29/16* (2006.01)
*B41M 5/34* (2006.01)

(52) U.S. Cl.
CPC ..... *B41M 5/34* (2013.01)
USPC ..... 347/179

(58) Field of Classification Search
USPC ..... 347/179, 171
See application file for complete search history.

(56) References Cited

U.S. PATENT DOCUMENTS

| | | | | |
|---|---|---|---|---|
| 7,324,237 | B2 * | 1/2008 | Okada | 347/179 |
| 8,456,497 | B2 * | 6/2013 | Iguchi et al. | 347/179 |
| 2010/0315475 | A1 * | 12/2010 | Taki et al. | 347/179 |
| 2011/0292419 | A1 | 12/2011 | Shibuya | |
| 2012/0038732 | A1 * | 2/2012 | Iguchi et al. | 347/179 |

* cited by examiner

*Primary Examiner* — Kristal Feggins
(74) *Attorney, Agent, or Firm* — Amin, Turocy & Watson, LLP

(57) ABSTRACT

An image forming apparatus comprises a feed section configured to feed a medium; an image forming section configured to form an image on the surface of the medium with a thermally erasable recording material or a recording material which is not thermally erasable; a heating section configured to heat the medium; a control section configured to conduct a control in a color erasing mode. The image forming apparatus also comprises a color erasing counter configured to count up, according to the size of the medium, the number of the mediums the color of which is thermally erased in the color erasing mode; and a print counter configured to count up, according to the size of the medium, the number of the mediums on which an image is fixed in the image formation mode.

5 Claims, 15 Drawing Sheets

156

| CONSUMABLE NAME | CORRECTION COEFFICIENT |
|---|---|
| PAPER FEED ROLLER | 1 |
| PHOTOCONDUCTIVE DRUM | 0.5~1 |
| CHARGER | 1 OR 0 |
| DEVELOPING AGENT | 0.5~1 OR 0 |
| TRANSFER MEMBER | 0 |
| CLEANING BLADE | 0.5 |
| FIXING ROLLER | 1~1.5 |
| PRESS ROLLER | 1~1.5 |

IMAGE FORMING APPARATUS AND IMAGE FORMING METHOD

CROSS-REFERENCE TO RELATED APPLICATION

This application is based upon and claims the benefit of priority from Japanese Patent Application No. 2013-097756, filed May 7, 2013, the entire contents of which are incorporated herein by reference.

FIELD

Embodiments described herein relate to an image forming apparatus and an image forming method.

BACKGROUND

There is a known image forming apparatus which forms an image with a color erasable recording material (e.g. toner) and a known image erasing apparatus which is capable of changing the state of an image from a color developed state to a color erased state. The color of a color erasable toner is erased by cutting off the bonding of a pigment with coloring agent by heating. In the conventional image erasing apparatus, to erase the color of a toner image, the paper on which the image is formed needs to be heated, for example, about 2 hours at 120-150 degrees centigrade.

For the reason that about 2 hours of heating and almost 1 hour of cooling are needed for the color erasing of an image, an image forming apparatus and an image erasing apparatus are currently provided as separate different apparatus.

DETAILED DESCRIPTION

An image forming apparatus comprises a feed section configured to feed a medium; an image forming section configured to form an image on the surface of the medium with a thermally erasable recording material or a recording material which is not thermally erasable; a heating section configured to heat the medium; a control section configured to conduct a control in a color erasing mode so that the medium, which is stored in the feed section and on which an image is formed with thermally erasable recording material, is subjected to a thermal color erasing processing by the heating section without being subjected to an image forming processing by the image forming section, and to conduct a control in an image formation mode so that the medium stored in the feed section is subjected to an image forming processing by the image forming section and then subjected to an image fixing processing by the heating section; a color erasing counter configured to count up, according to the size of the medium, the number of the mediums the color of which is thermally erased in the color erasing mode; and a print counter configured to count up, according to the size of the medium, the number of the mediums on which an image is fixed in the image formation mode.

Embodiment 1

Figure 1:
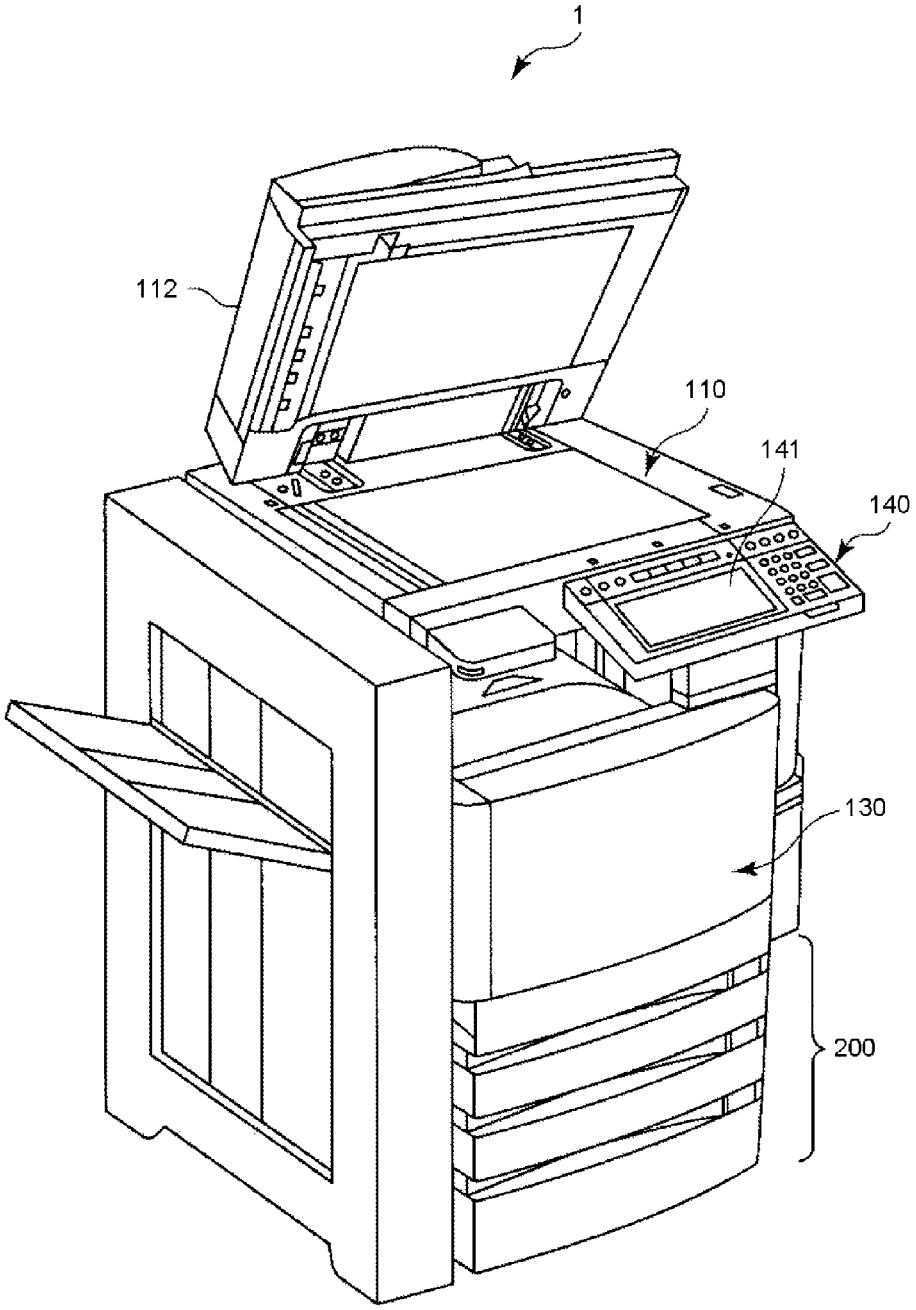
FIG. 1 is an oblique view illustrating the schematic shape of an image forming apparatus according to embodiment 1.

FIG. 1 is an oblique view illustrating the schematic shape of an image forming apparatus according to embodiment 1.

In an image forming apparatus 1, there are arranged a printing section 130, a sheet tray 200, a scanning section 110, an automatic document feeding section 112 and a control panel 140.

The printing section 130 outputs image information as output image called as, for example, hard copy or printout. The sheet tray 200 feeds an output medium, that is, paper of various sizes used for an image output, to the printing section 130. The scanning section 110 acquires image information from an original document as image data. The automatic document feeding section 112 feeds a read original document from a reading position to a discharging position and guides the next original document to the reading position. The control panel 140 is an instruction input section for instructing operations of the image forming apparatus 1, such as the start of the image formation in the printing section 130 or the start of the reading of image information from an original document by the scanning section 110. A display section 141 is arranged in the control panel 141 to input an instruction and display information an the operator.

Figure 2:
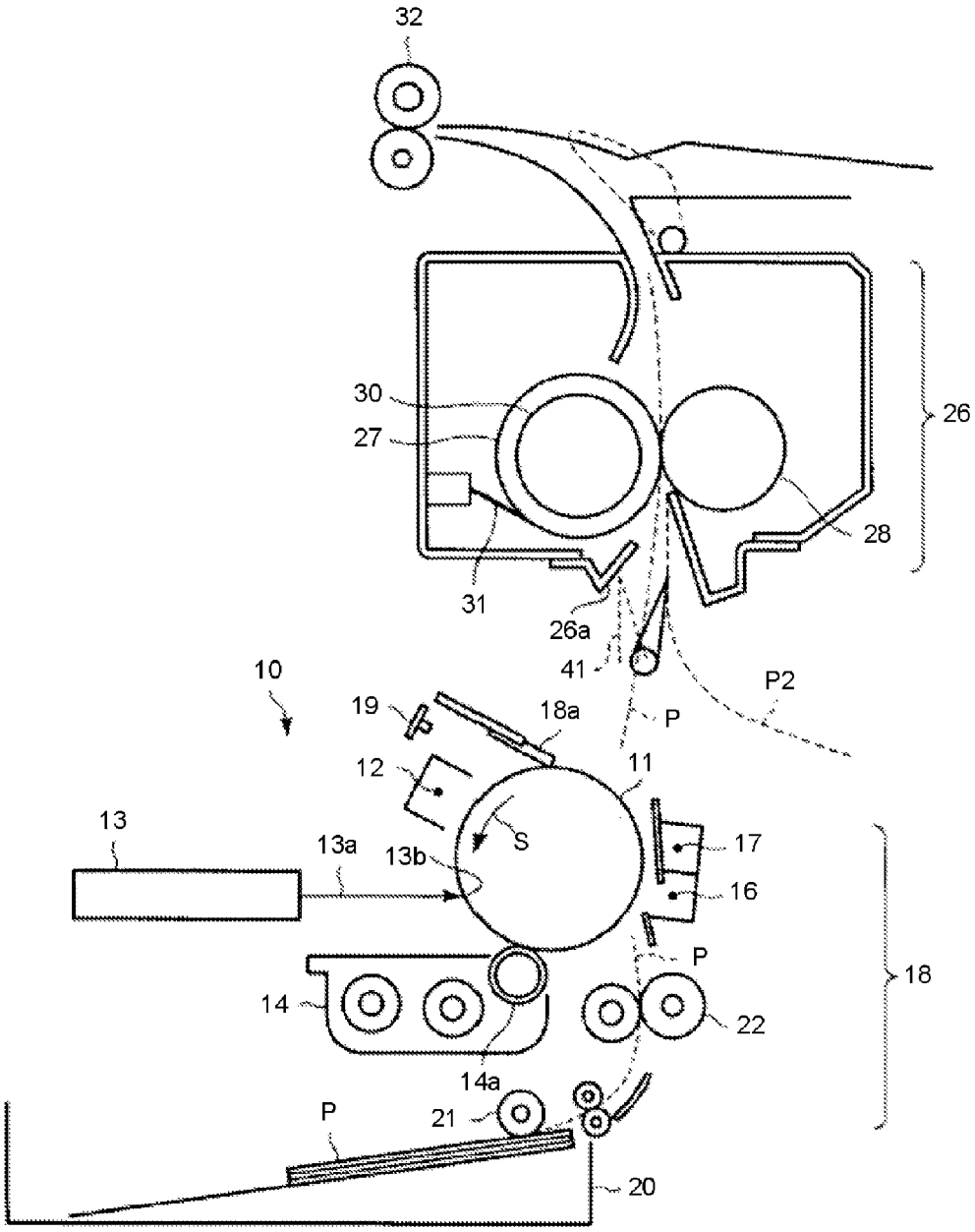
FIG. 2 is a constitution diagram illustrating the constitution of a fixer of the image forming apparatus according to embodiment 1.

FIG. 2 is a diagram illustrating the constitution of an image forming section 10 and a fixer 26 of the image forming apparatus described in embodiment 1. The image forming apparatus 1 described in embodiment 1 forms an image with the toner the color of which can be erased by heating. Further, the image forming apparatus 1 has a function of erasing the color of a toner image.

A photoconductive drum 11 of the image forming section 10 has an organic photo conductor (OPC) on the surface of a supporting member having a diameter ϕ of 60 mm. The photoconductive drum 11 is driven in the direction indicated by an arrow s at a 'first paper conveyance speed' (circumferential speed) of 215 mm/sec. A charger 12, a laser exposure device 13, a developing device 14, a transfer charger 16, a peeling charger 17, a cleaner 18 equipped with a cleaning blade 18*a* and a charge removing LED 19 are arranged around the photoconductive drum 11.

The charger 12 uniformly charges the photoconductive drum 11 to −750V sequentially along with the rotation of the photoconductive drum 11. The laser exposure device 13 radiates an irradiated position 13*b* on the charged photoconductive drum 11 with laser light 13*a* corresponding to the image information.

Paper P serving as a recording medium is taken out from a paper feed cassette 20 by a paper feed roller 21. The paper P is conveyed to the position of the transfer charger 16 of the image forming section 10 by a register roller 22 in synchronization with the formation of a toner image on the photoconductive drum 11. An unfixed toner image is formed on the paper P by the image forming section 10 with a color erasable toner. The paper feed cassette 20 is capable of synchronously feeding an unused sheet and a reusable sheet.

The fixer 26 arranged above the image forming section 10 heats, presses and fixes the paper P serving as a recording medium. The fixer 26 has a fixing roller 27 serving as a fixing rotator and a press roller 28 serving as a press rotator propped against the fixing roller 27. Further, the fixer 26 comprises an entrance guider 26*a* for guiding the paper P to the nip between the fixing roller 27 and the press roller 28.

The fixing roller 27 is formed by coating PTFE (Polytetrafluoroethylene) on the surface of a hollow cylindrical cylinder made of metal. There is an internal IH (induction heating) coil 30 in the fixing roller 27. The fixing roller 27 is inductively heated directly from the inside. The surface temperature of the fixing roller 27 is detected by a thermistor 31. The current of the IH coil 30 is controlled through the output of the thermistor 31 so as to control the surface temperature of the fixing roller 27 at a specified temperature.

The press roller 28 is formed by forming an elastic layer including foamed silicone sponge rubber and the like on a metal shaft, and then covering the surface of the elastic layer with a PFA (copolymer of tetrafluoroethylene and Perfluoalkylvinylether) tube. Measured by an ASKER-C, the hardness of the press roller 28 is about 55°. The press roller 28 enlarges, through the elastic layer, a nip to be about 6 mm wide to seek for a low heat capacity for energy-saving fixation.

A paper discharging roller 32 is arranged at the downstream side of the fixer 26 in the conveyance direction of the paper P to discharge the fixed paper P in a given direction.

Figure 3:
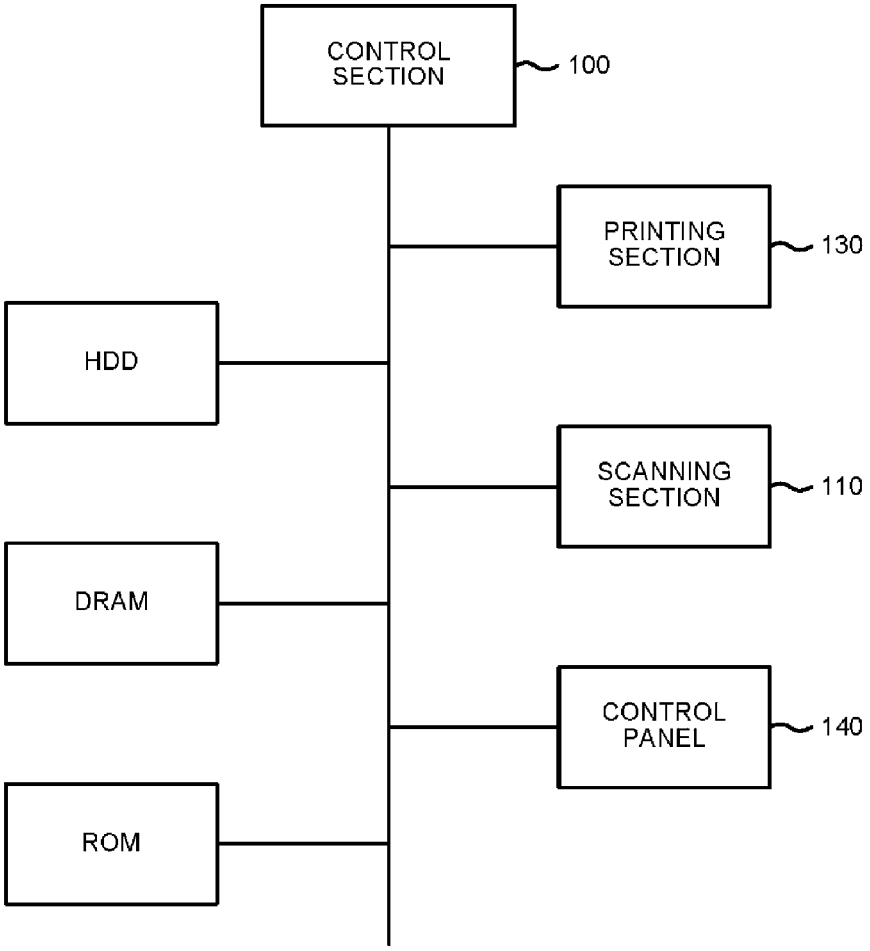
FIG. 3 is a block diagram illustrating the constitution of a control system of the image forming apparatus according to embodiment 1.

FIG. 3 is a block diagram illustrating the constitution of the control system of the image forming apparatus 1 described in embodiment 1.

In addition to the aforementioned printing section 130, scanning section 110 and control panel 140, the image forming apparatus 1 further comprises a control section 100, a ROM, a DRAM and an internal memory device (HDD). Moreover, the aforementioned sections are connected with each other via a system bus line.

The control section 100 controls the sections which are connected with each other via the system bus line. Various control programs required for the operation of the image forming apparatus 1 are stored in the ROM. The programs for controlling an image forming operation and an image erasing operation which will be described later are stored in the ROM. The execution of each program is controlled by the control section 100. The DRAM is a buffer memory for temporarily storing the data generated during the execution of each program.

Figure 4:
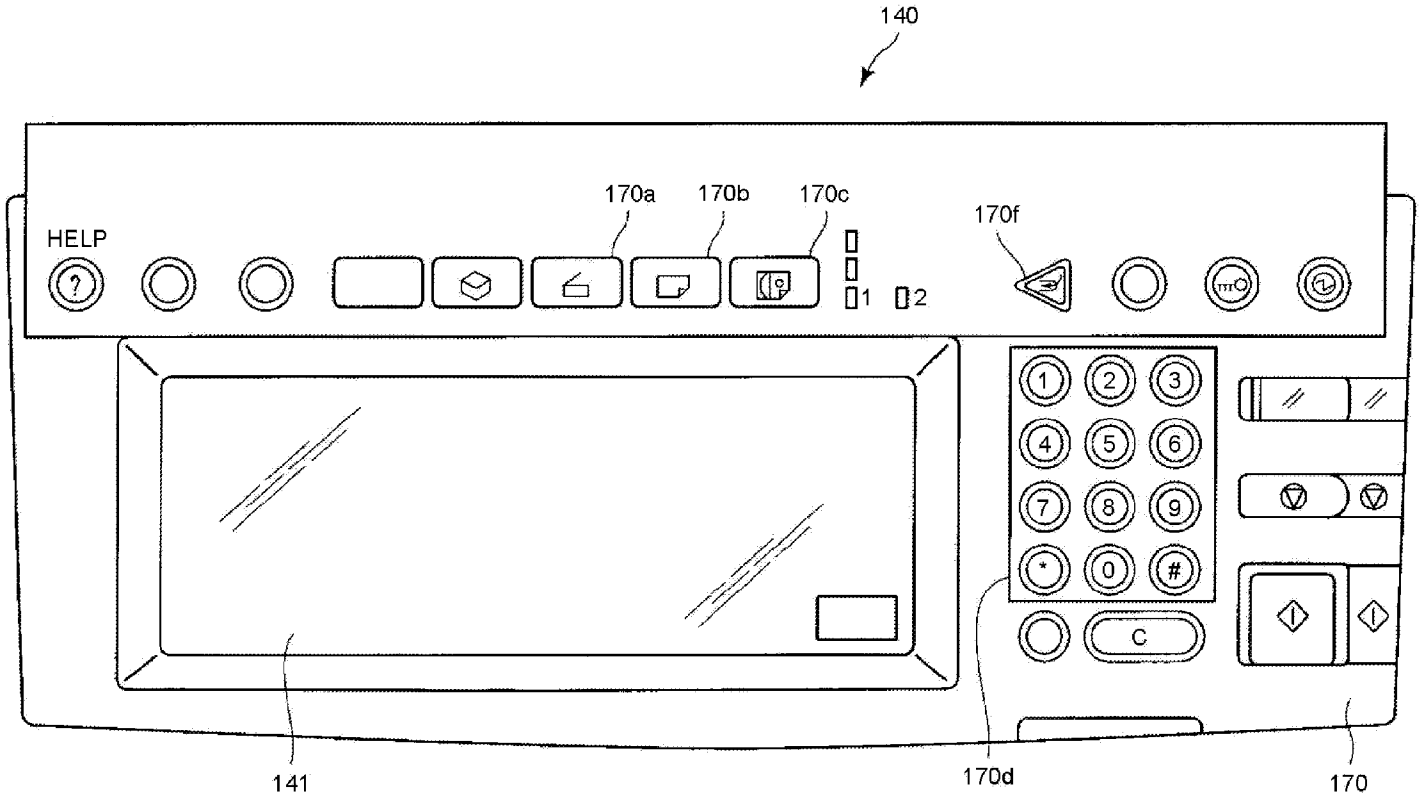
FIG. 4 is an external view of a control panel arranged on an image forming apparatus according to embodiment 1.

FIG. 4 is an external view of the control panel 140 of the image forming apparatus 1 described in embodiment 1. A touch panel display 141 and an operation section 170 are arranged on the control panel 140. The touch panel display 141 consisting of a touch panel displays the state of the image forming apparatus 1, an operation procedure and various instructions given to the user. Various operating buttons for operating the image forming apparatus 1, including a 'start' button, are arranged on the operation section 170.

For example, if a 'scan' button 170*a* is pressed, then an original document is scanned to acquire image data, and the acquired image data is stored in the DRAM of the image forming apparatus 1. If a 'copy' button 170*b* is pressed, then an image is formed on the medium according to the image data acquired. If a 'fax' button 170*c* is pressed, then the image formed according to the acquired image data is faxed. If a keyboard 170*d* is operated, a numeric string can be input.

Next, the image formation process of the image forming apparatus 1 is described.

With the start of the image formation process, in the image forming section 10, the photoconductive drum 11 rotating along the direction indicated by the arrow s at the 'first paper conveyance speed' (circumferential speed) of 215 mm/sec is uniformly charged to −750V by the charger 12. Moreover, the laser exposure device 13 irradiates the photoconductive drum with laser light corresponding to original document information to form an electrostatic latent image. Sequentially, the electrostatic latent image is developed by the developing device 14 with a color erasable toner to form, on the photoconductive drum 11, a toner image with the color erasable toner.

In embodiment 1, a capsule thermally erasable toner prepared using the following chemical method is used as the color erasable toner.

(1) binder resin and WAX atomized solution

Pes resin is used as the binder resin. Resin atomized solution is prepared with Pes resin, an anionic emulsifier and neutralizing agent using a high pressure homogenizer.

(2) adjusting of WAX dispersion obtain atomized solution with a rice WAX in the way the aforementioned resin is prepared.

(3) toner adjusting leuco dye: CVL (Crystal Violet Lactone)

developing agent: 4-Hydroxybenzoic acid Benzyl temperature controlling agent: lauric acid-4-Benzyl oxy phenyl ethyl prepare toner by heating and melting the materials above, encapsulating the solution using the well-known coacervation method, agglutinating and blending the encapsulated coloring material, the toner binder resin dispersion and the WAX dispersion with sulfuric acid Al [Al2(SO4)3], washing and drying the material obtained; then, add a proper external additive into the toner; the toner is hereinafter referred to as a capsule color erasable toner.

Further, the capsule color erasable toner used in embodiment 1 is prepared in such a manner that the 10 wt % of the toner before external addition is the quantity of the encapsulated coloring material.

The developing device 14 uses a two-component developing agent composed of the foregoing capsule color erasable toner having a volume average particle diameter of 5-12 um and a magnetic carrier having a volume average particle diameter of 30-80 um. The true specific gravity of the capsule color erasable toner is in a range of about 0.9-1.2 g/cm$^3$. The color erasable toner image formed on the paper is heated to above 90 degrees centigrade to cut off the bonding of the pigment and the coloring material in the capsule to erase the color of the toner image. A development bias of about −550V is applied to the developing roller 14*a* of the developing device 14 to form a toner image on the electrostatic latent image on the photoconductive drum 11 through reversal development.

On the other hand, paper P is fed from the paper feed cassette 20. The paper P is conveyed to the position of the transfer charger 16 by the register rollers 22 in synchronization with the formation of a toner image on the photoconductive drum 11 to transfer the toner image on the photoconductive drum 11.

After being peeled from the photoconductive drum 11, the paper P transferred with the toner image is conveyed to the fixer 26. Further, the surface temperature of the fixing roller is controlled to be 140 degrees centigrade. The paper P is inserted between the fixing roller 27 and the press roller 28 to heat, press and fix the toner image. The fixing roller 27 and the press roller 28 are formed in a reverse crown shape, thus, two end parts of the paper P inserted into the nip between the fixing roller 27 and the press roller 28 are guided prior to the center part of the paper P. The generation of a crumple is prevented as the paper P is heated, pressed and fixed while being pulled from the center part to end parts due to the reverse crown shape of the press roller 28. After being fixed by the fixer 26 with the toner image formed with the capsule color erasable toner, the paper P s discharged in a given direction by the paper discharging roller 32.

After the transfer is completed, the photoconductive drum 11 removes residual toner with the cleaner 18 and residual charges with the charge removing LED 19, and then the image forming process is ended.

In the case of the 'first paper conveyance speed' (circumferential speed) of 215 mm/sec, the temperature of the encapsulated coloring material will not exceed 90 degrees centigrade, thus, no color is erased during the formation of an image. However, the image density (0.3) of the fixed image formed based on capsule color erasable toner is reluctantly acceptable in the aspect of visibility. Thus, to guarantee the visibility of the image, it is desired that the quantity of the coloring material of the capsule color erasable toner is more than 10 wt %. Additionally, the visibility of the image is evaluated by a measurer (e.g. X-rite).

Next, the conventional image erasing process is described below.

Currently, the color of a capsule toner image is erased using, for example, a dedicated color erasing apparatus: 'color erasing apparatus for e-blue (trade mark): TMD-HE01', produced by Toshiba Corporation (Joint-stock). In the apparatus, paper P is heated about 2 hours at 120-150 degrees centigrade to erase the color of a toner image. Then, the paper P is automatically cooled about 1 hour. To reuse paper P the toner image on which is erased, the paper which are thermally stunk with each other are gently fed into the paper feed cassette 20 to be peeled from each other. The paper P fed to the paper feed cassette 20 for reuse is formed with an image during the image formation process. However, as the color erasing processing of the foregoing color erasing apparatus takes time, paper cannot be reused immediately.

In embodiment 1, the color of an image is erased by the image forming apparatus 1 by putting the instant erasing characteristic of the color erasable toner to good use.

Figure 5:
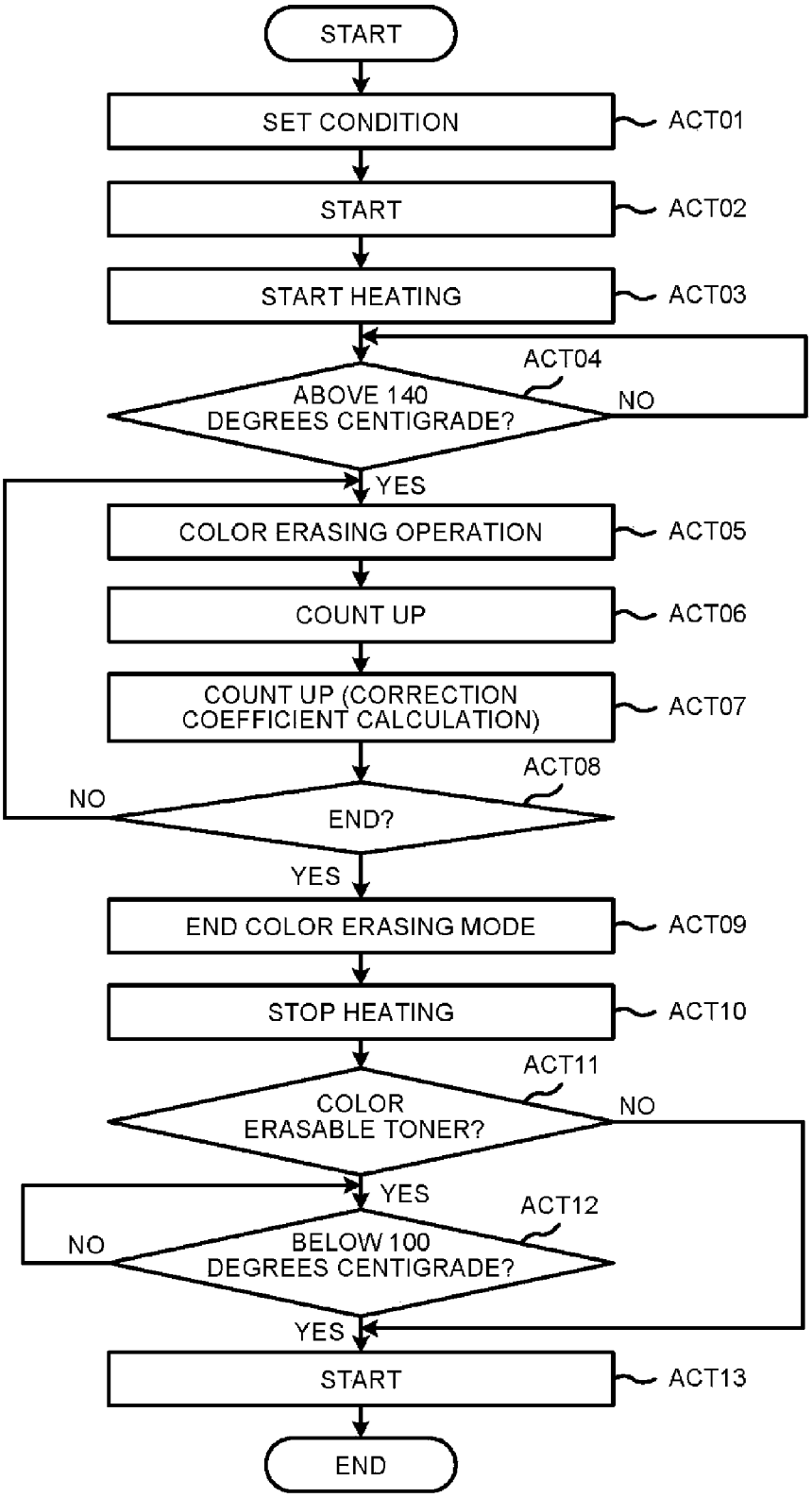
FIG. 5 is a flowchart illustrating an image erasing operation carried out by the image forming apparatus according to embodiment 1.

FIG. 5 is a flowchart illustrating an image erasing operation carried out by the image forming apparatus 1 described in embodiment 1.

Further, the following operations are carried out by the control section 100 of the image forming apparatus 1.

The paper P, on which an image is formed with the capsule color erasable toner, is placed in the paper feed cassette 20 to be reused after the color of the toner image formed on the used paper P is erased by the user. The paper P formed with an image may also be placed in a specific cassette 20 or a manual device.

In ACT 01, the user sets, from the control panel 140, a condition for a color erasing mode.

Figure 6:
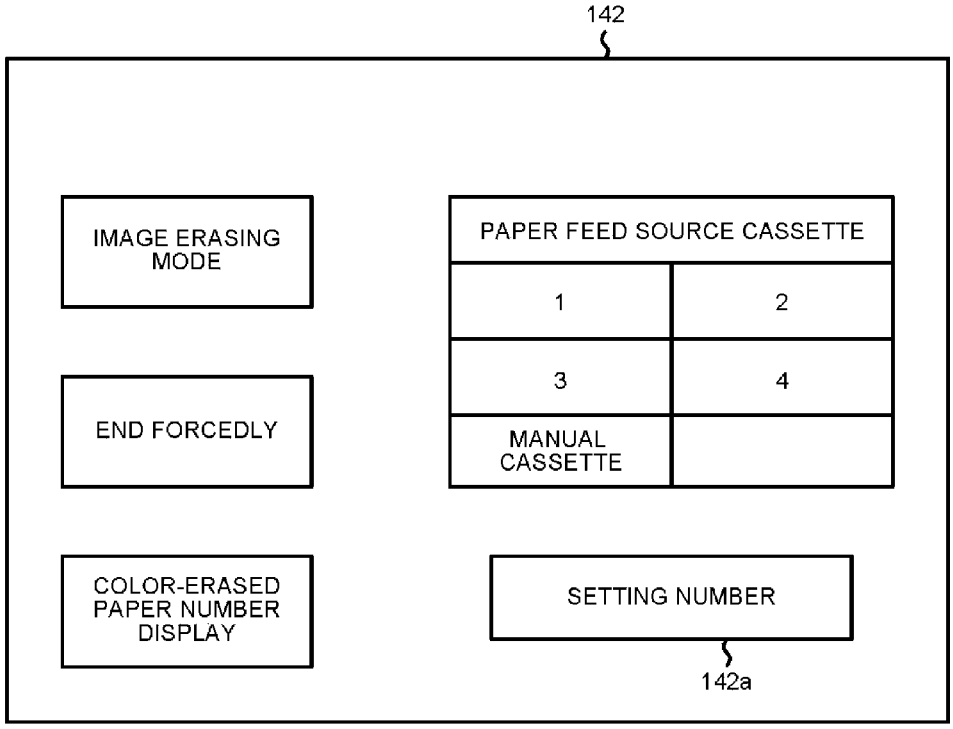
FIG. 6 is a diagram showing an image erasing operation screen displayed on the control panel according to embodiment 1.

FIG. 6 is a diagram showing an image erasing operation screen 142 displayed on the control panel 140 described in embodiment 1.

The user presses an 'image erasing mode' button on the image erasing operation screen 142 and designates, from cassettes 1-4 and a manual cassette, a cassette as a paper feed source cassette to store reusable paper P. Herein, a plurality of cassettes, but not one, may be designated as the paper feed source cassette. The number of the pieces of paper P to be erased in color is set by the user. A numeric string, if input by the user from the keyboard 170*d*, is displayed in a setting number column 142*a*.

Moreover, a color erasing mode (a color erasing operation) is started in ACT 02 once the user presses the 'start' button on the operation section 170 of the control panel 140. Further, the image erasing operation screen 142 may be formed by fitting an operation button for erasing the color of an image on the conventional operation screen, but is not limited to the structure above. Further, paper can be taken out from a specific cassette to be reused, without designating a cassette.

In ACT 03, the fixing roller 27 starts to be heated. In embodiment 1, the image forming apparatus 1 carries out an image forming operation with a color erasable toner or an ordinary toner (color inerasable). Thus, in a print mode (print operation), the temperature of the fixing roller is controlled to below 100 degrees centigrade, for example, to a set temperature of 80 degrees centigrade, so that the toner image is not at a temperature above a color erasing temperature of 90 degrees centigrade.

Consequentially, in ACT 04, the fixing roller is heated to above 140 degrees centigrade to erase the color of the color erasable toner. Then, a color erasing operation is carried out in ACT 05 when the temperature of the fixing roller is above 140 degrees centigrade (YES in ACT 04).

In the image erasing mode, the photoconductive drum 11 is driven towards the direction indicated by the arrow s at a first paper conveyance speed (circumferential speed) of 21 mm/sec. In the image erasing mode, no electrostatic latent images are formed by the laser exposure device 13 on the photoconductive drum 11 corresponding to image information. That is, paper P is conveyed to the fixer 26 through the route used in the aforementioned image process.

In the image erasing mode, the fixer 26 also conveys paper at a 'second paper conveyance speed' of 21 mm/sec while heating/pressing and fixing the paper. At this time, the surface temperature of the fixing roller 27 is 140 degrees centigrade as well. By heating paper at a conveyance speed lower than that in an image formation process, the toner image formed on the paper is heated to above 90 degrees centigrade to erase the color of the toner image by means of the instant erasing characteristic of the capsule color erasable toner.

The various counters arranged in the image forming apparatus 1 act corresponding to the color erasing operation.

Figures 15, 16:
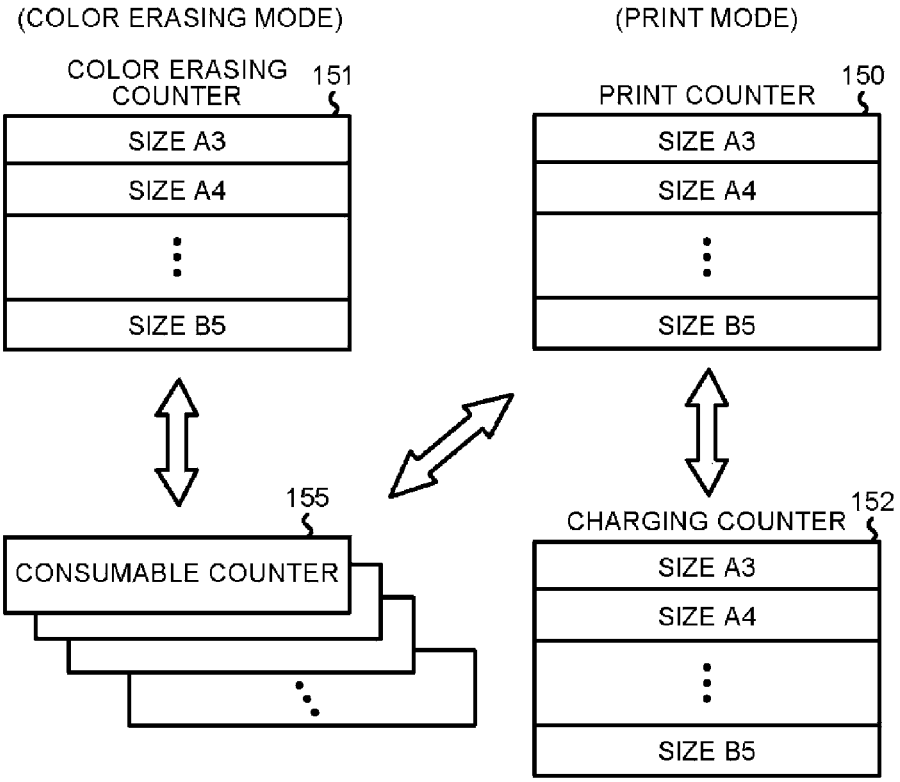
FIG. 15 is a diagram showing various counters in the image forming apparatus according to embodiment 1.
FIG. 16 is a diagram illustrating one example of the content of a consumable counter correction coefficient table in which correction coefficients of the consumable counter in the image forming apparatus described in embodiment 1 are stored.

FIG. 15 is a diagram showing the various counters in the image forming apparatus 1 described in embodiment 1. There is a print counter 150, a color erasing counter 151, a charging counter 152 and a consumable counter 155 in the image forming apparatus 10. Further, the counters may be designed as hardware or as data stored in the HDD or DRAM to be counted up using a piece of software.

When images are printed on paper P, the print counter 150 counts up the number of the pieces of printed paper P of each size (e.g. A3, A4, B5 . . . ). When a color erasing processing is conducted on paper P, the color erasing counter 151 counts up the number of the pieces of color-erased paper P of each size. When images are printed on the paper P, the charging counter 152 counts up the number of the pieces of paper P for each size so as to charge the user a fee. When the image forming apparatus 1 operates, the consumable counter 155 counts up the operation times (the number of the pieces of paper) for calculating the service life of a consumable. The operation of the consumable counter will be described later in detail.

Here, when the image printing apparatus 1 runs in a print mode, the print counter 150, the charging counter 152 and the consumable counter 155 carryout a counting operation. When the image printing apparatus 1 runs in a color erasing mode, the color erasing counter 151 and the consumable counter 155 carry out a counting operation.

In ACT 06 shown in FIG. 5, the control section 100 adds up each size of color-erased paper in the color erasing counter 151. Moreover, in ACT 07, the control section 100 adds up each piece of color-erased paper in the consumable counter 155. Further, the value added up by the consumable counter 155 in the color erasing mode is a corrected count value obtained using a correction coefficient.

FIG. 16 is a diagram illustrating the content of a consumable counter correction coefficient table 156 in which correction coefficients of the consumable counter 155 in the image forming apparatus 1 described in embodiment 1 are stored. In the consumable counter correction coefficient table 156, a correction coefficient for use in a color erasing mode is set for each consumable. A corrected count value is obtained by the multiplying the number of the pieces of paper by the correction coefficient.

The setting on correction coefficients relate to consumables is exemplified blew.

To pick up paper P from a cassette, the paper feed roller 21 carries out the same operation in a color erasing mode and a print mode. Thus, the correction coefficient for the paper feed roller 21 is 1.

The photoconductive drum 11 acts as well in the color erasing mode to convey the paper. However, no developing agent is fed in the color erasing mode, thus, film is lessened. For this sake, the correction coefficient for the photoconductive drum 11 is set to 0.5-1. The charger 12 operates or stops corresponding to the running condition of the photoconductive drum 11. Thus, the correction coefficient for the charger 12 is set to 1 or 0. Here, the correction coefficient '0' indicates that the charger 12 is not operated (stopped).

In the color erasing mode, the developing device 14 runs or not. When the developing device 14 is not running, the correction coefficient for a developing agent is 0. When the developing device 14 is running, the stirring of the developing agent in the developing device without the supply of new developing agent may degrade quality. For this sake, the correction coefficient for the developing agent is set to 0.5-1.

The correction coefficient for a transfer member (transfer charger 16 and peeling charger 17) which are idle in the color erasing mode, is set to 0. The cleaning blade 18*a* is worn as no developing agent is used in the photoconductive drum 11 in the color erasing mode. Thus, the correction coefficient for the cleaning blade 18*a* is set to 0.5.

The fixing roller 27 and the press roller 28 heat paper P, in spite of the color erasing mode or the print mode. However, as in the color erasing mode, the fixing temperature is higher than that in used the print mode while the fixing speed is lower than that used in the print mode, a higher heat load is born in the color erasing mode than in the print mode. Therefore, correction coefficients for the fixing roller 27 and the press roller 28 are set to within a range from 1 to 1.5.

Further, as stated later, in the color erasing mode, paper P is sometimes conveyed to the fixer 26, bypassing the photoconductive drum 11. In this case, it is assumed that proper consumable counter correction coefficients are set based on the discussion above.

In ACT 08 shown in FIG. 5, whether or not to end the color erasing mode is determined. For example, the color erasing mode is ended if the color of a given number of mediums is erased. Further, if there is no medium in a related paper feed cassette (the cassette is empty), the color erasing mode is ended even if a given number of mediums are not erased in color.

If a condition for ending the color erasing mode is not met (NO in ACT 08), the flow returns to ACT 05 to conduct a color erasing operation. If the condition for ending the color erasing mode is met (YES in ACT 08), the color erasing mode is ended in ACT 09. In Act 10, the heating for the fixing roller 27 is stopped.

In ACT 11, whether or not the toner used in the image forming apparatus 1 is a color erasable toner is determined. Whether or not the used toner is a color erasable toner can be automatically determined by the image forming apparatus 1 by reading toner information (e.g. color erasable toner or color inerasable toner, color erasing temperature) from a mark affixed on a toner cartridge, or set by the user from the control panel 140. Further, when it is unclear whether or not the toner used is a color erasable toner, it can be determined that the toner used is a color erasable toner.

In the case of the use of a color erasable toner (YES in ACT 11), the apparatus stands by in ACT 12 till the temperature of the fixing roller is below 100 degrees centigrade. Moreover, when the temperature of the fixing roller is below 100 degrees centigrade (YES in ACT 12), it can be determined that the heating temperature in the fixer 26 is below a temperature at which the color of the color erasable toner is erased. A print mode is started in ACT 13.

On the other hand, if no color erasable toner is used (NO in ACT 11), the print mode is started in ACT 13, saving the apparatus from standing by till the temperature of the fixing roller is below 100 degrees centigrade.

To which specific temperature the fixing roller is reduced to free the apparatus from a standby state can be automatically determined by the image forming apparatus 1 by reading toner information (e.g. color erasable toner or color inerasable toner, color erasing temperature) from a mark affixed on a toner cartridge, or set by the user from the control panel 140.

Further, an 'end forcedly' button is set on the image erasing screen 142 to end the image erasing mode forcedly. When the 'end forcedly' button is operated, the image erasing mode is ended to return to another given mode (ordinary print mode, Ready mode or energy-saving mode).

Further, in the embodiment described above, the fixing roller 27 is heated; however, the press roller 28 may be heated along with the fixing roller 27. Paper P is placed in the paper feed cassette 20 with the surface printed with a color erasable toner directly contacted with the fixing roller 27, however, the present invention is not limited to this, paper P may also be placed in the paper feed cassette 20 in such a manner that the back side of the paper P opposite to the surface printed with a color erasable toner is directly contacted with the fixing roller 27. An appropriate selection on a heating condition, such as the constitution of the fixing roller 27 and the press roller 28 or not and a heating temperature, the 'second paper conveyance speed', a paper thickness and a paper type can be regarded as an image erasing mode, not relying on the placement of paper in the paper feed cassette 20.

Next, the operations carried out by the image forming apparatus 1 in the print mode are described corresponding to the operations carried out by the image forming apparatus 1 in the color erasing mode.

Figure 17:
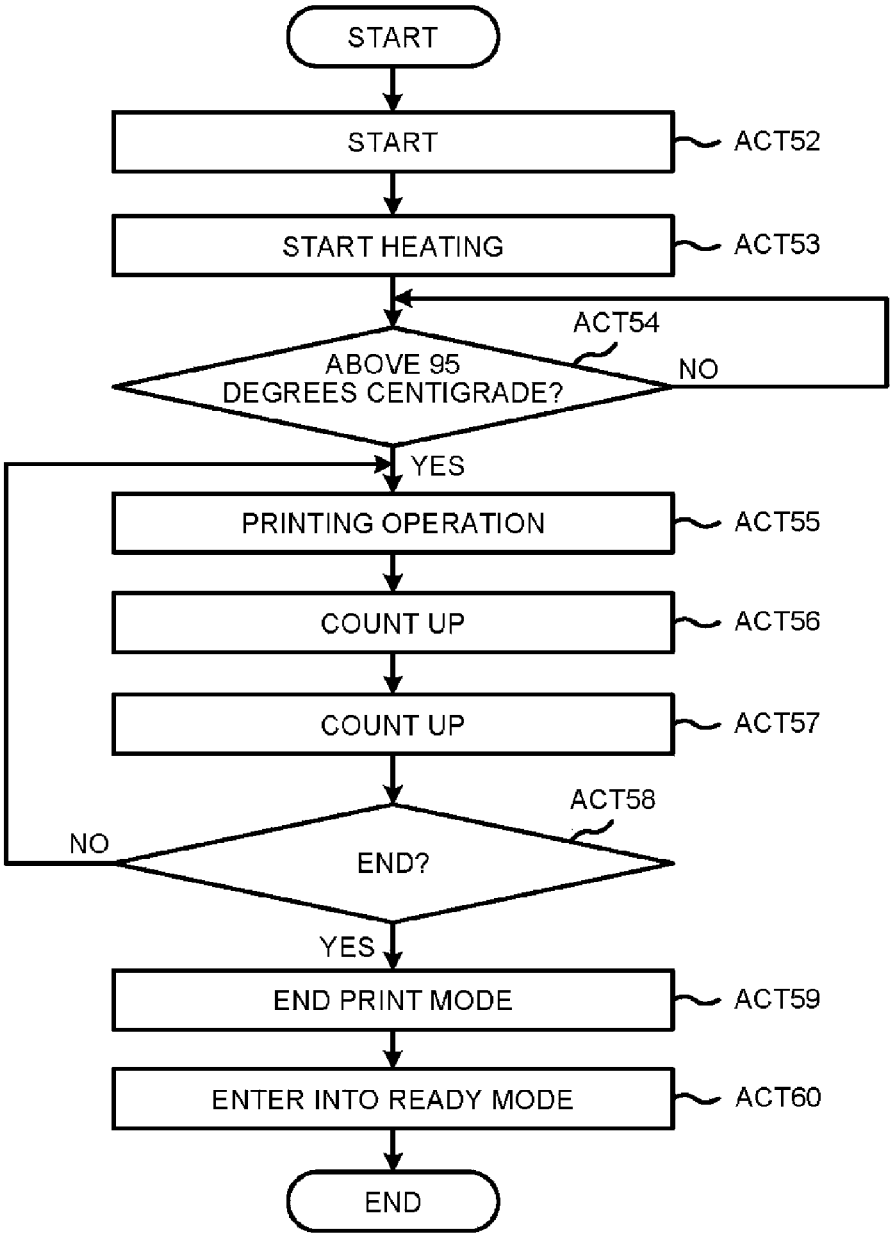
FIG. 17 is a flowchart illustrating a printing operation carried out by the image forming apparatus according to embodiment 1.

FIG. 17 is a flowchart illustrating a printing operation carried out by the image forming apparatus 1 described in embodiment 1.

Further, the following operations are carried out by the control section 100 of the image forming apparatus 1.

The print mode (a 'copy' operation) is started in ACT 52 once the user presses the 'start' button on the operation section 170 of the control panel 140 after placing an original document in the automatic document feeding section 112.

In ACT 53, the fixing roller 27 starts to be heated. In embodiment 1, the image forming apparatus 1 carries out an image forming operation with a color erasable toner or an ordinary toner (color inerasable). Sequentially, the temperature of the fixing roller is controlled to be below 100 degrees centigrade, for example, to be a set temperature of 80 degrees centigrade, so that the toner image is not at a temperature above a color erasing temperature of 90 degrees centigrade.

Thus, the fixing temperature is heated to a temperature higher than a fixing temperature of 95 degrees centigrade in ACT 54. Moreover a print operation is carried out in ACT 55 when the temperature of the fixing roller is above 95 degrees centigrade (YES in ACT 54).

The various counters arranged in the image forming apparatus 1 act corresponding to the print operation.

In ACT 56, the control section 100 adds up each size of color-erased paper in the print counter 150. Meanwhile, the charging counter 152 conducts a counting operation as well. Moreover, in ACT 57, the control section 100 counts up each piece of printed paper in the consumable counter 155. Different from in the color erasing mode, the consumable counter 155 counts using no correction coefficient in the print mode.

In ACT 58, whether or not to end the print mode is determine. For example, the print mode is ended if a given number of mediums are printed.

If a condition for ending the print mode is not met (NO in ACT 58), the flow returns to ACT 55 to conduct a print operation. If the condition for ending the print mode is met (YES in ACT 58), the print mode is ended in ACT 59. The apparatus enters into a Ready mode in ACT 60.

Embodiment 2

Different from in embodiment 1, in embodiment 2, the user is (visually) prompted with a message indicating the degree of the contribution made by the user to environment by erasing, with the image forming apparatus, the color of an image formed on a piece of paper to reuse the paper. In embodiments 1 and 2, identical elements are denoted by identical reference symbols and are therefore not described repeatedly here.

Figure 7:
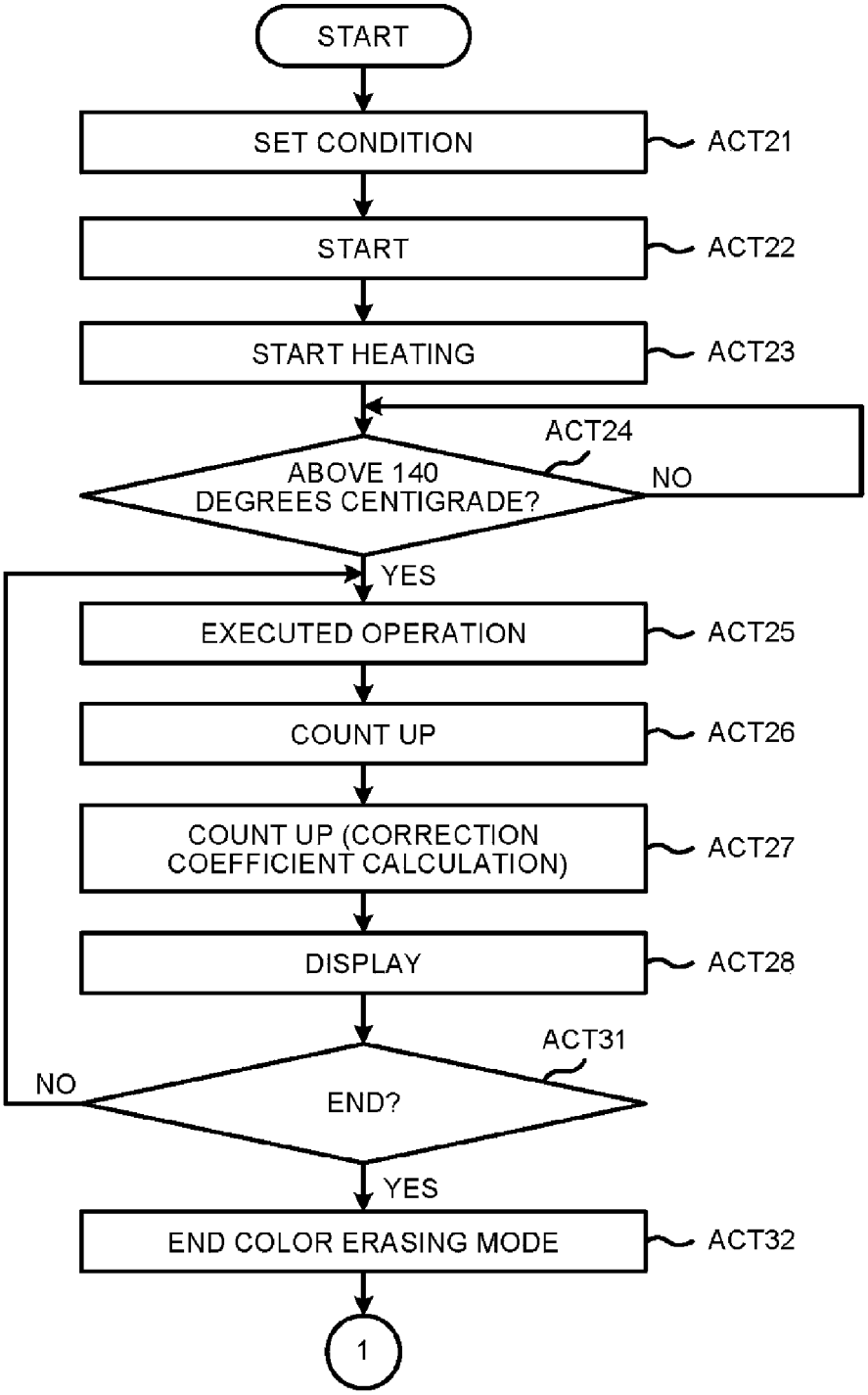
FIG. 7 is a flowchart illustrating an image erasing operation carried out by an image forming apparatus according to embodiment 2.
Figure 8:
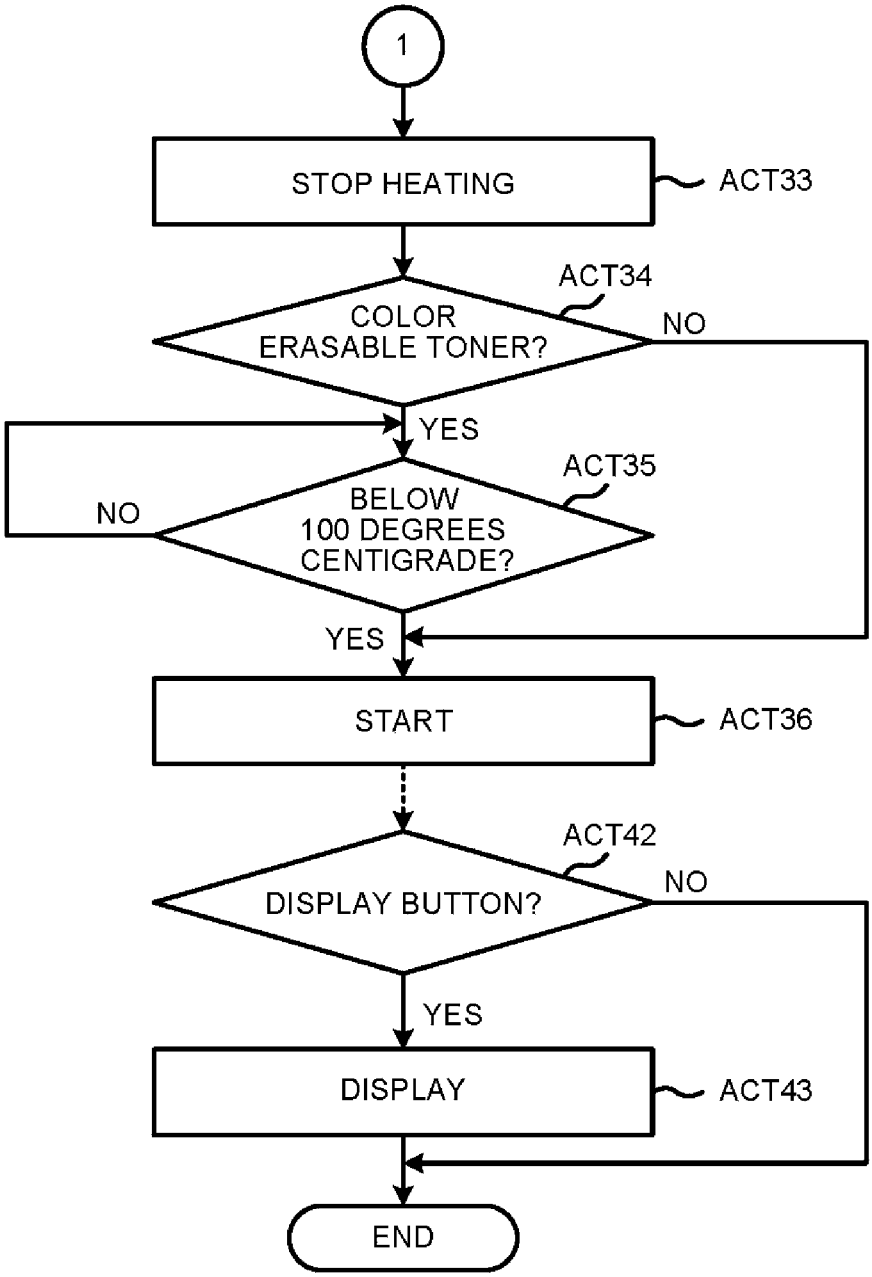
FIG. 8 is a flowchart illustrating an image erasing operation carried out by the image forming apparatus according to embodiment 2.

FIG. 7 and FIG. 8 are flowcharts illustrating an image erasing operation carried out by an image forming apparatus 1 according to embodiment 2.

In ACT 21, the user sets, from the control panel 140, a condition for a color erasing mode. The user presses an 'image erasing mode' button on the image erasing operation screen 142 shown in FIG. 6 and designates, from cassettes 1-4 and a manual cassette, a cassette as a paper feed source cassette to store reusable paper P. Herein, a plurality of cassettes, but not one, may be designated as the paper feed source cassette at the same time. Moreover, a color erasing mode (a color erasing operation) is started in ACT 22 when the user press the 'start' button on the operation section 170 of the control panel 140.

In ACT 23, the fixing roller 27 starts to be heated. The fixing roller is heated to above 140 degrees centigrade to erase the color of the color erasable toner in ACT 24. Moreover, a color erasing operation is carried out in ACT 25 when the temperature of the fixing roller is above 140 degrees centigrade (YES in ACT 24). The color erasing operation is the same as that described in embodiment 1 and is therefore not described here repeatedly.

In ACT 26, the color erasing counter 151 counts up each size of color-erased paper. Moreover, in ACT 27, the control section 100 counts up each piece of color-erased paper in the consumable counter 155. Further, the value counted up by the consumable counter 155 in the color erasing mode is a corrected count value obtained using a correction coefficient. Moreover, the counted number of the pieces of used paper is stored in a memory, and the number of the pieces of color-eased paper is displayed in ACT 28 matching with a color erasing operation.

Figure 9:
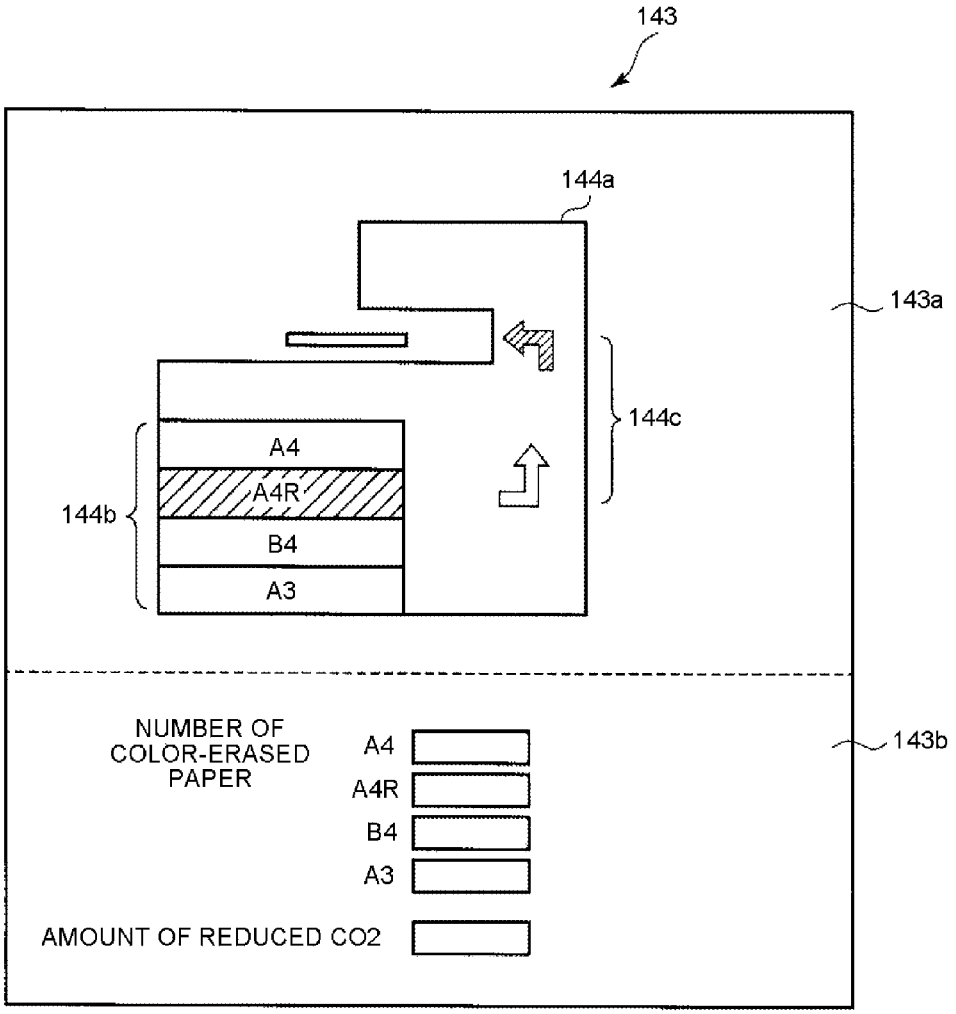
FIG. 9 is a diagram showing a color erasing condition display screen on an image forming apparatus according to embodiment 2.

FIG. 9 is a diagram showing a color erasing condition display screen 143 on an image forming apparatus according to embodiment 2.

An image display area 143*a* and an information display area 143*b* are set on the color erasing condition display screen 143. A pattern 144*a* representing an image forming apparatus 1, a pattern 144*b* representing a cassette and a pattern 144*c* representing an arrow are displayed in the image display area 143*a*. In the pattern 144*b* representing a cassette, the size of the paper stored in each cassette is displayed, and colors are switched to indicate the currently used cassette. Moreover, in the pattern 144*c* representing an arrow, the current position (cassette→image forming section→fixer→discharging section) of the paper taken out from a cassette is tracked and displayed in real time.

The number of the pieces of color-erased paper and the amount of reduced CO2 are displayed in the information display area 143*b* in real time according to the foregoing color erasing operation. The number of the pieces of color-erased paper refers to the number of the pieces of paper erased in color after the start of the color erasing operation. The amount of reduced CO2 is represented by the following formula (I):

The amount of reduced CO2=the amount of CO2 reduced for each piece of paper×the number of the pieces of color-erased paper the amount of CO2 reduced for each piece of paper=the amount of CO2 required to produce a piece of paper−the energy (the amount of CO2) required to erase the color of one piece of paper formula (I)

In ACT 31 shown in FIG. 7, whether or not to end the color erasing mode is determined. If a condition for ending the color erasing mode is not met (NO in ACT 31), the flow returns to ACT 25 to conduct a color erasing operation. If the condition for ending the color erasing mode is met (YES in ACT 31), the color erasing mode is ended in ACT 32. In ACT 33, the heating for the fixing roller 27 is stopped.

In ACT 34, whether or not the toner used in the image forming apparatus 1 is a color erasable toner is determined. Whether or not the used toner is a color erasable toner can be automatically determined by the image forming apparatus 1 by reading information from a mark affixed on a toner cartridge, or set by the user from the control panel 140. Further, when it is unclear whether or not the toner used is a color erasable toner, it can be determined that the toner used is a color erasable toner.

In the case of the use of a color erasable toner (YES in ACT 34), the apparatus stands by in ACT 35 till the temperature of the fixing roller is below 100 degrees centigrade. Moreover, when the temperature of the fixing roller is below 100 degrees centigrade (YES in ACT 35), it can be determined that the heating temperature in the fixer 26 is below a temperature at which the color of the color erasable toner is erased. A print mode is started in ACT 36.

On the other hand, if no color erasable toner is used (NO in ACT 34), a print mode is started in ACT 36, saving the apparatus from standing by till the temperature of the fixing roller is below 100 degrees centigrade.

After the print mode is started in ACT 36, the accumulated number of the pieces of color-erased paper is displayed on the control panel 140 in ACT 43 after the user presses a color-erased paper number display button on the image erasing operation screen 142 shown in FIG. 6 (YES in ACT 42). The accumulated number of the pieces of color-erased paper is the accumulated value of the number of the paper subjected to color erasing processing from an initial moment optionally set by the user till now.

Further, in addition to the foregoing content, the number of the pieces of color-erased paper may be counted up for each standard paper size, then the accumulated number of the pieces of the color-erased paper, or the number of the pieces of color-erased paper for each standard paper size or the amount of CO2 reduced through a color erasing processing may also be displayed on the color erasing condition display screen 143.

As stated above, in embodiment 2, the contribution made by the user to environment is visually presented to motivate the user to be environment-friendly. The user is further motivated to make contribution to environment by giving benefits to the user according to, for example, the accumulated number of the pieces of color-eased paper or the accumulated amount of reduced CO2.

Embodiment 3

The different point between the embodiment 3 and the embodiment 1 is that the paper will not pass the photoconductive drum 11 in an image erasing mode in the embodiment 3. In embodiments 1 and 3, identical elements are denoted by identical reference symbols and are therefore not described repeatedly here.

A color erasing operation carried out in embodiment 3 is described below with reference to FIG. 2.

When the color of a toner image formed with a capsule color erasable toner is erased, paper P is placed in a paper feed section (not shown). When the start of an image erasing mode is input, the paper P is fed to a paper feed path P2, bypassing the photoconductive drum 11. The paper P is conveyed on the path P2 and is switched by a gate 41 to be guided into the fixer 26. The conveyance speed is a 'second paper conveyance speed' of 21 mm/sec, which is different from the 'first paper conveyance speed' of 215 mm/sec, and at which the fixer 26 conveys the paper P while heating/pressing and fixing the paper.

The toner image on the paper P is heated in the fixer 26. By thermally cutting off the bonding of a coloring material with a developing agent, the image is changed into a color erased state from a color generated state. The color erasing for the image is completed by erasing the color of the capsulated toner image. A paper discharging roller 32 is arranged at the downstream side of the paper P conveyance direction of the fixer 26 to discharge the color-erased paper P to a given direction. If placed in the paper feed cassette 20 again, the paper P can be reused to be formed with an image.

Further, the operation condition of the fixer 26 is the same as that in an image erasing processing described in embodiment 1. Further, like in embodiment, when 'Fax', 'Print' or 'Copy' jobs are accepted in an image erasing mode, the image erasing mode is not interrupted, and the jobs are printed in a sequence accepted in the image erasing mode after the image erasing mode is ended (no paper to be erased in color) and the apparatus enters into a print state.

Embodiment 4

Embodiment 4 is different from embodiment 1 in the amount of the coloring material in a capsule color erasable toner. In embodiments 1 and 4, identical elements are denoted by identical reference symbols and are therefore not described repeatedly here.

In embodiment 4, the capsule color erasable toner is prepared with the capsule coloring material accounting for 30% by weight of the toner added with no additive. The use of capsule color erasable toners containing different amounts of the coloring material is tested in the way described in embodiment 1.

The obtained fixed image is high in image density and excellent in visibility. However, the color of the capsule is left in the color-erased toner image as residual from a color erasing processing after the image erasing operation described in embodiment 1 is carried out for the toner image. The image density is 0.2 after the color erasing processing, and to reuse the paper repeatedly, noise serving as a background is within a reluctantly acceptable range. Thus, to erase the color of an image effectively, it is desired that the quantity of the coloring material of the capsule color erasable toner is less than 30 wt %.

According to embodiment 1, to guarantee the visibility of an image, it is desired that the quantity of the coloring material of the capsule color erasable toner is more than 10 wt %. According to embodiment 4, to erase the color of an image effectively, it is desired that the quantity of the coloring material of the capsule color erasable toner is less than 30 wt %. Thus, it is considered that the desirable quantity of the coloring material of the capsule color erasable toner is 10 wt %-30 wt %.

Embodiment 5

Embodiment 5 is different from embodiment 1 in that during a color erasing process, paper is conveyed at the speed at which the paper is conveyed during an image formation process. In embodiments 1 and 5, identical units are denoted by identical reference symbols and are therefore not described repeatedly here.

In embodiment 5, the capsule color erasable toner is prepared with the capsule coloring material accounting for 30% by weight of the toner added with no additive. When the color of a toner image formed with the capsule color erasable toner is erased, paper P is placed in the paper feed cassette 20. When the start of an image erasing mode is input, the photoconductive drum 11 of the image forming section 10 is driven towards the direction indicated by the arrow s at the first paper conveyance speed (circumferential speed) of 215 mm/sec at which the paper is conveyed during an image formation process.

In the image erasing mode, no electrostatic latent images are formed by the laser exposure device 13 on the photoconductive drum 11 corresponding to image information. Like in the foregoing image formation process, the paper P is conveyed to the fixer 26 at the first paper conveyance speed (circumferential speed) of 215 mm/sec. In the image erasing mode, the fixer 26 conveys the paper while heating/pressing and fixing the paper at a 'second fixing temperature' of 190 degrees centigrade which is higher than the fixing temperature mentioned in embodiment 1. Under this condition, the toner image on the paper can be heated to above 90 degrees centigrade so that the color of the paper P is erased by means of the instant erasing characteristic of the capsule color erasable toner.

Further, in the case where the interval between paper conveyed in the image erasing mode is the same as that between paper conveyed during an image formation process, that is, about 80 mm, the discharged paper may be stuck with each other by the toner. As the temperature of just discharged paper is high, the toner resin is stuck on back sides of soft and overlapped paper. Thus, the result of a test on various changed paper intervals shows that discharged paper are not stuck with each other when the paper interval is about 40 mm in the image erasing mode even if a color erasing processing is carried out for 100 pieces of successive paper. The reason for this lies in that a piece of paper is discharged after the former piece of paper is cooled.

Thus, if paper are fed to the fixer 26 at a time interval of about 2 seconds (≈400/215 sec), then the paper can be prevented from sticking with each other.

Embodiment 6

The difference of embodiment 6 from embodiment 1 lies in the constitution of the fixer. In embodiments 1 and 6, identical elements are denoted by identical reference symbols and are therefore not described repeatedly here.

Figure 10:
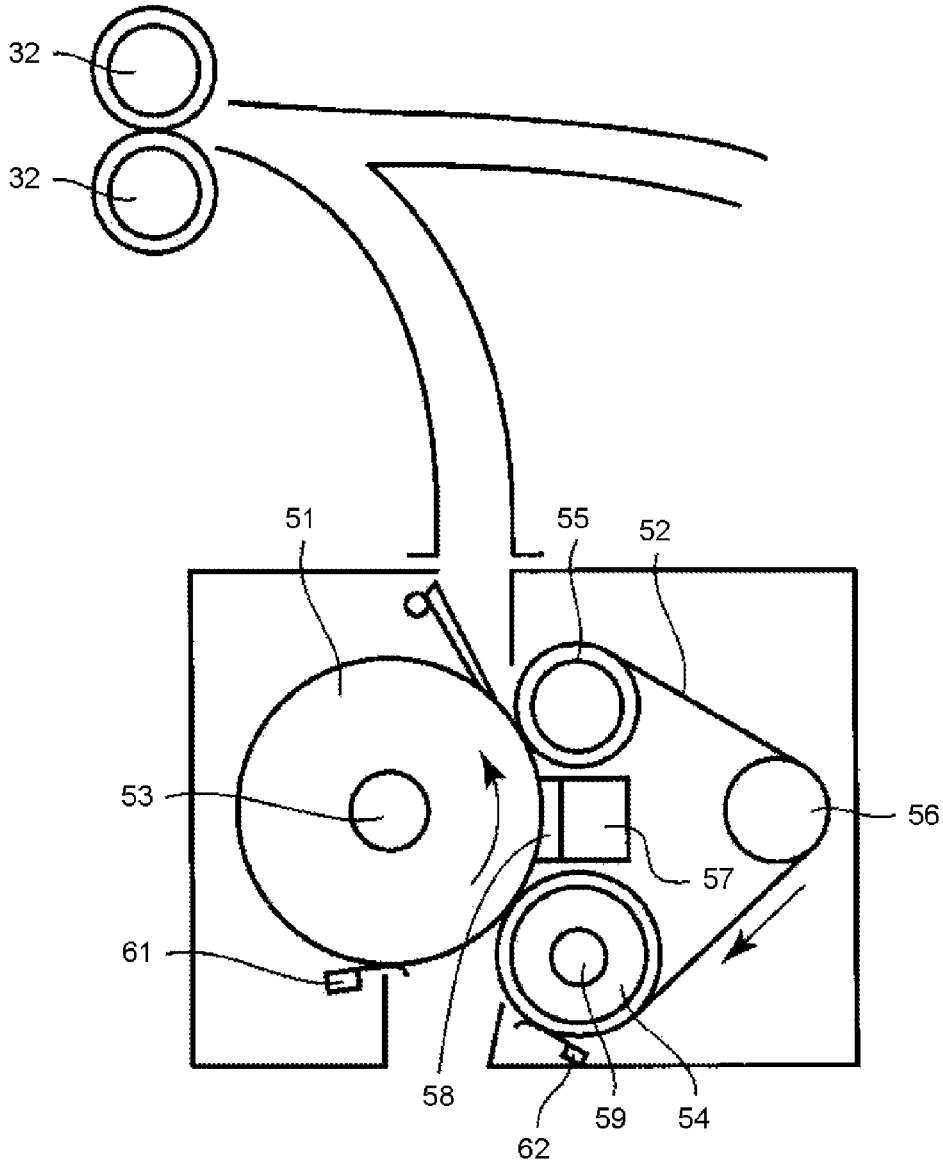
FIG. 10 is a diagram illustrating the constitution of a fixer of an image forming apparatus according to embodiment 6.

FIG. 10 is a diagram illustrating the constitution of the fixer 26 of an image forming apparatus 1 according to embodiment 6.

The fixer 26 is equipped with a heat roller 51 serving as a cylindrical fixing member and a press belt 52 serving as a continuously rotating press member. The press belt 52 covering a given range is propped against the outer circumferential surface of the heat roller 51 to form a fixing nip part. A heat roller lamp 53 consisting of halogen lamps is arranged inside the heat roller 51 as a heat source.

The press belt 52 is wound on a belt heat roller 54 located at the upstream side of a conveyance direction and a press roller 55 located at the downstream side of the conveyance direction, striding a tension roller 56. A fixing nip part is formed between the belt heat roller 54 and the press roller 55. The press roller 55 makes the press belt 52 contacted with the heat roller 51 under pressure to form the entrance of the fixing nip part. Further, a press pad 58 is held on a press pad bracket 57 arranged at the inner side of the press belt. By pressing the press pad 58 towards the internal circumferential surface of the press belt 52 from the center of the fixing nip part, the press belt 52 is contacted with the heat roller 51 under the pressure.

The belt heat roller 54 is formed into a hollow roller in which a press belt lamp 59 made up of an iodine tungsten lamp is arranged as a heat source.

The surface temperature of the heat roller 51 is detected by a thermistor 61 for the fixing member which is contacted with the outer circumferential surface of the heat roller 51, and the surface temperature of the press belt 52 in the heat roller 54 is detected by a thermistor 62 for the press member which is contacted with the outer circumferential surface of the press belt 52.

Figure 11:
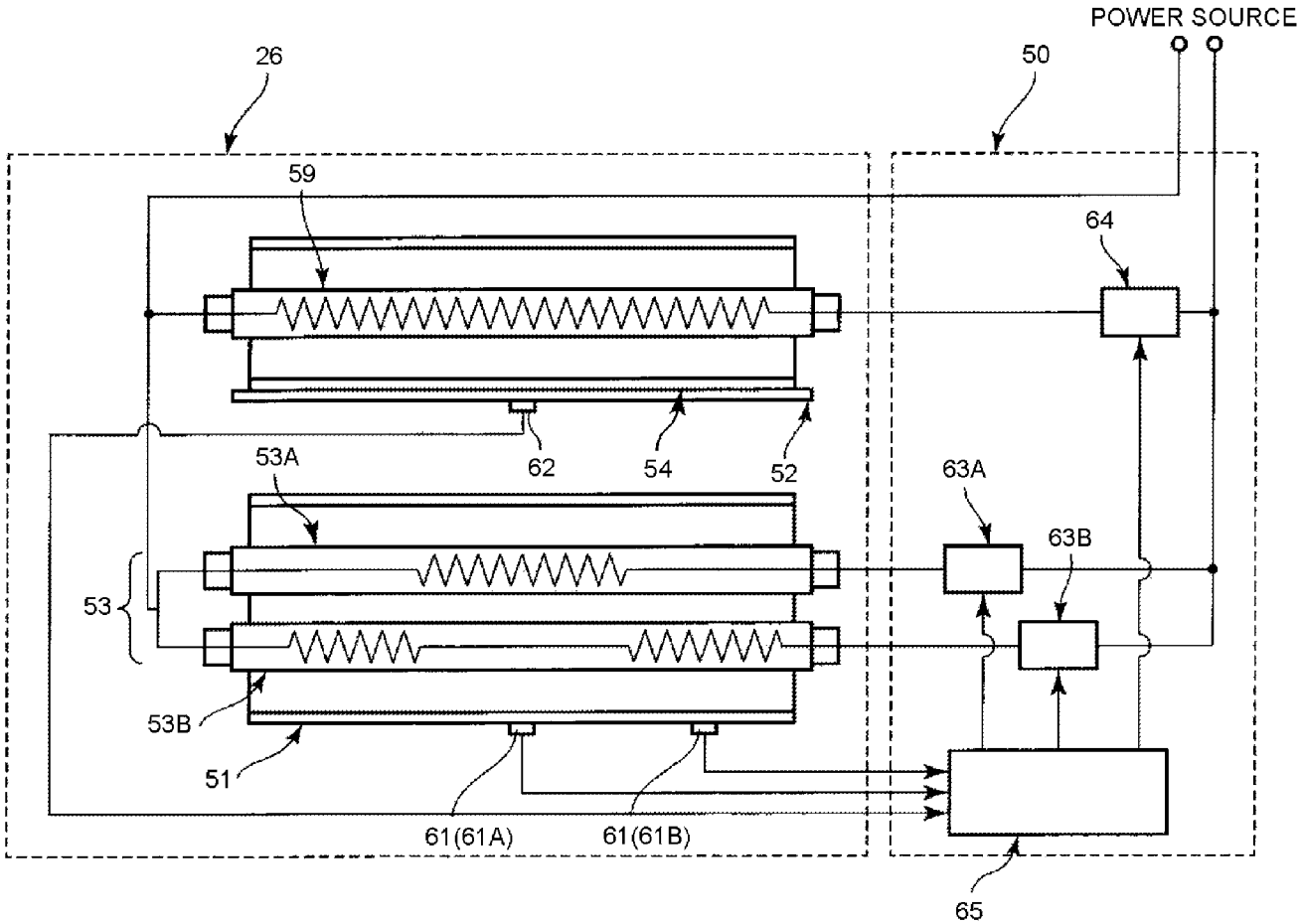
FIG. 11 is a diagram illustrating the constitution of a heating mechanism of the fixer of the image forming apparatus according to embodiment 6.

FIG. 11 is a diagram illustrating the constitution of the heating mechanism of the fixer 26 of an image forming apparatus 1 described in embodiment 6. A heating mechanism inside the fixer 26 and a power supply control section 50 for controlling the power supply for the heating mechanism are shown in FIG. 11.

The halogen lamps 53 arranged inside the heat roller 51 consist of a center lamp 53A for the heat roller which heats the center part of the heat roller 51 in the length direction of the heat roller 51 and a side lamp 53B for the heat roller which heats the two end parts of the heat roller 51 in the length direction of the heat roller 51. Further, the press belt lamp 59 arranged inside the belt heat roller 54 covers and heats the whole part of the belt heat roller 54 in the length direction of the belt heat roller 54.

The center lamp 53A for the heat roller, the side lamp 53B for the heat roller and the press belt lamp 59 are electrically connected with a center lamp switching element 63A, a side lamp switching element 63B and a press belt lamp switching element 64, respectively. A temperature controller 65 controls the ON/OFF of the switching element to supply a commercial alternating current or cut off the supply of the commercial alternating current to control temperature. Further, the switching element may be bi-directional thyristors.

Thermistors for the fixing member consist of a center thermistor 61A for the heat roller which detects the surface temperature of the center part of the heat roller 51 in the length direction of the heat roller 51 and a side thermistor 61A for the heat roller which detects the surface temperature of an end part of the heat roller 51 in the length direction of the heat roller 51. The temperatures detected by the center thermistor 61A for the heat roller and the side thermistor 61A for the heat roller are input to the temperature controller 65. Further, a thermistor 62 for the press member detects the surface temperature of the center part of the press belt 52 in the width direction of the press belt 52. The detected temperature is input to the temperature controller 65.

The temperature controller 65 controls the ON/OFF of each lamp according to the temperatures detected by the thermistors 61A, 61B and 62, thereby carrying out a temperature control. Further, the temperature controller 65 comprises a ROM (not shown) for storing a temperature control program and a RAM (not shown) for storing temperature control parameters.

Embodiment 7

The difference of embodiment 7 from embodiment 1 lies in the constitution of an image forming apparatus. In embodiments 1 and 7, identical elements are denoted by identical reference symbols and are therefore not described repeatedly here.

Figure 12:
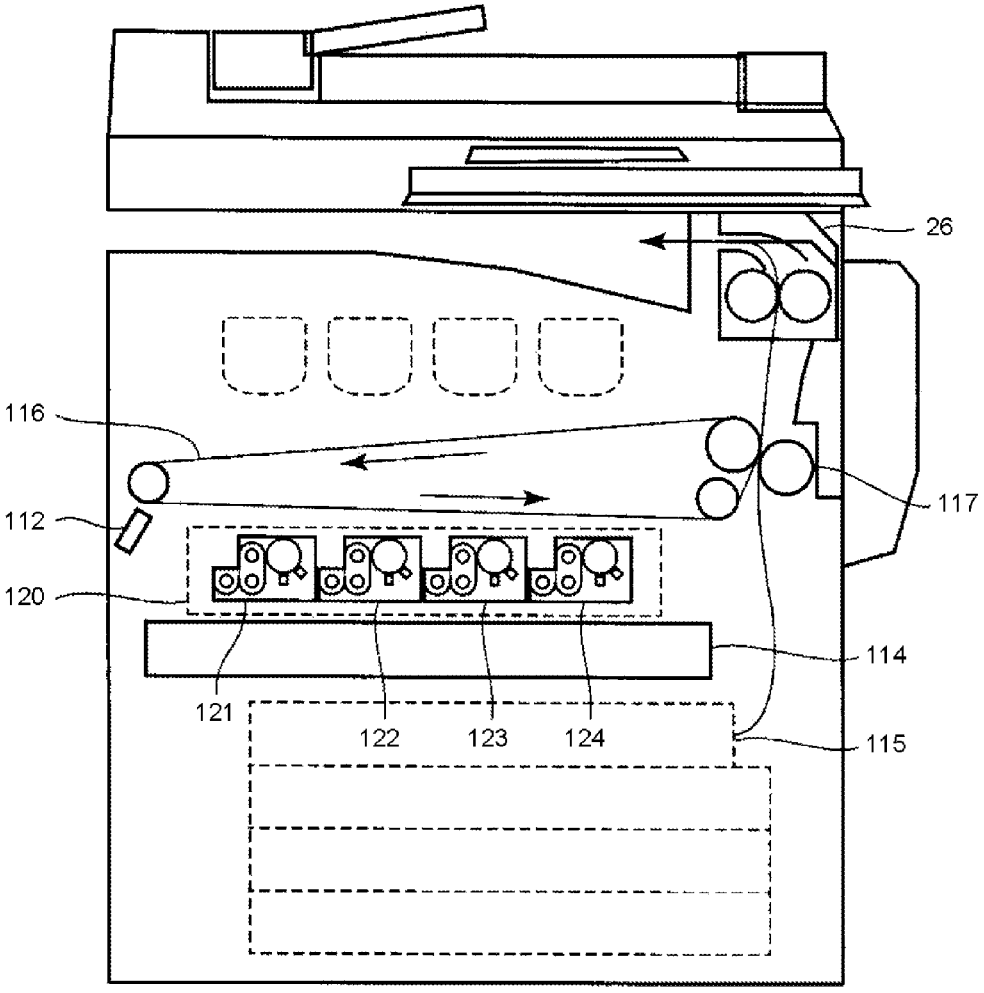
FIG. 12 is a schematic diagram illustrating the constitution of an image forming apparatus according to embodiment 7.

FIG. 12 is a schematic diagram illustrating the constitution of an image forming apparatus according to embodiment 7.

The image forming apparatus 1 described in embodiment 7 is an image forming apparatus using a multi-drum tandem process. The image forming apparatus 1 comprises a multi-drum tandem process 120, a blade (toner removing section) 112, a controller 114, a paper feeder 115, a primary transfer belt 116, a secondary transfer roller 117 and a fixer 26. Further, the multi-drum tandem process 120 comprises four process units 121, 122, 123 and 124.

Further, the process units 121, 122, 123 and 124 use Yellow (Y) toner, Magenta (M) toner, Cyan (C) toner and a color erasable toner, respectively. That is, in embodiment 7, the toner to be used is switched between a color erasable toner and a color inerasable toner, without changing toner cartridges.

Figure 13:
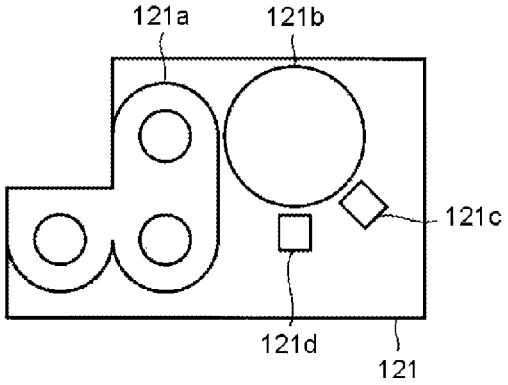
FIG. 13 is a diagram illustrating one example of the constitution of a process unit of the image forming apparatus according to embodiment 7.

FIG. 13 is a diagram exemplifying the constitution of the process unit 121 of the image forming apparatus described in embodiment 7. The process unit 121 comprises a developing device 121*a*, a photoconductive drum 121*b*, a charger 121*c* and an exposure device 121*d*.

In the process unit 121, the photoconductive drum 121*b* (image carrier) is charged by the charger 121*c* to have a specific potential and is irradiated by the exposure device 121*d* with laser light which is modulated in intensity according to image information, thereby forming an electrostatic latent image on the photoconductive drum 121*b* corresponding to an image which needs to be output. The electrostatic latent image formed on the photoconductive drum 121*b* is selectively supplied with toner by the magnetic brush of the developing device 121*a* and developed. The developed toner on the photoconductive drum 121*b* is transferred by the primary transfer belt 116 in an electric field. The process unit 121 is, but is not limited to be, a type of cleaner, but may be equipped with a cleaner. The other process units 122, 123 and 124 have the same constitution or carry out the same operation.

In the image forming apparatus 1 shown in FIG. 12, toners of different colors are transferred on the primary transfer belt 116 through the image formation of the process units 121, 122, 123 and 124. Then, paper is fed, a secondary transfer operation is carried out by the secondary transfer roller 117 and a fixing operation is carried out by the fixer 26, and then the paper is discharged from the image forming apparatus 1.

Figure 14:
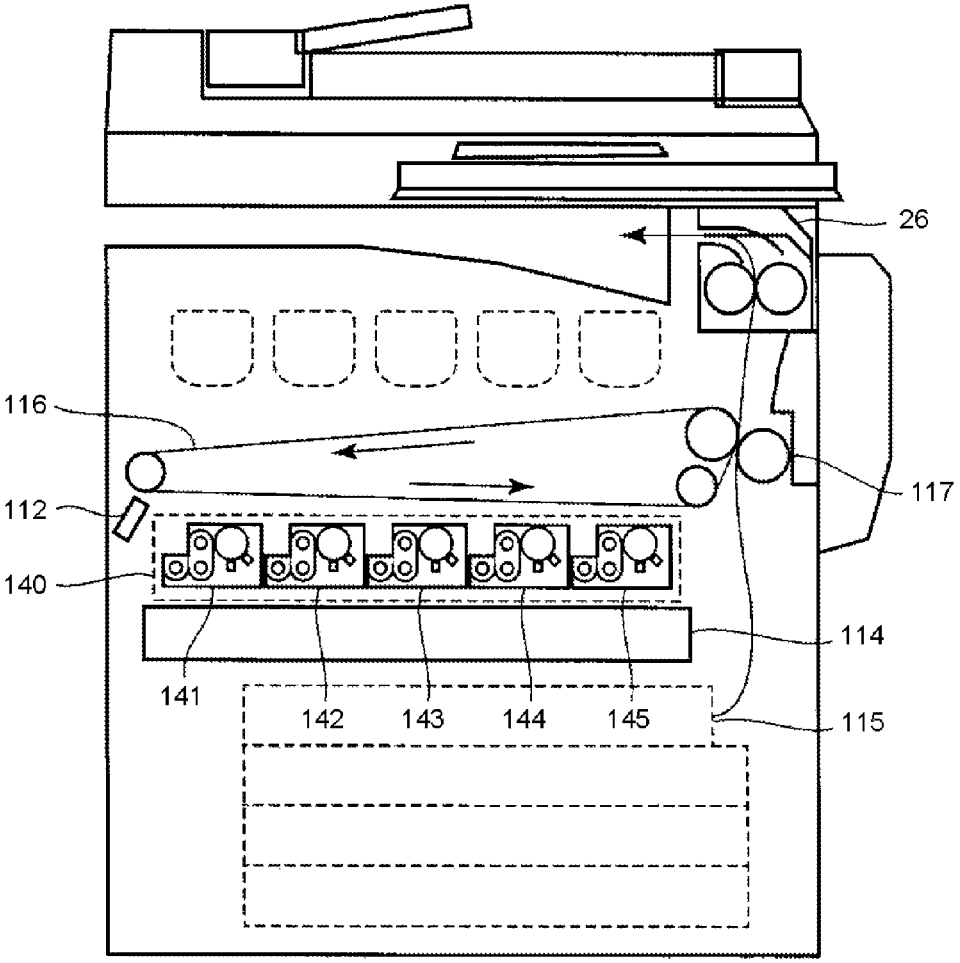
FIG. 14 is a schematic diagram illustrating the constitution of the image forming apparatus according to embodiment 7.

Further, the image forming apparatus 1 may have the constitution shown in FIG. 14, but is not limited to have the constitution shown in FIG. 12. Instead of the multi-drum tandem process 120, the image forming apparatus 1 shown in FIG. 14 comprises a multi-drum tandem process 140. Moreover, the multi-drum tandem process 140 consists of, for example, a process unit 141 using a color erasable toner and process units 142, 143, 144 and 145 using color inerasable toners of four colors (Y, M, C, K).

The image forming apparatuses provided in different embodiments are described above. In an image erasing, paper is conveyed at a speed lower than that at which paper is conveyed during an image formation process or the fixing temperature is higher than that used during the image formation process. The image erasing mode is realized on the running condition of a predetermined second paper conveyance speed or a second fixing temperature. However, it is considered that the value involved in the running condition for the image erasing mode can be appropriately changed according to the medium (type, thickness) used and the toner used.

Thus, for example, the feature (type, thickness) of the medium used and the feature (color erasing property) of the toner used may also be detected, and a running condition for the switch to the image erasing mode is acquired based on the setting input of a user. In this case, the following running methods can be appropriately combined according to the running condition.

(1) the second conveyance speed set in a conveyance control system in the image erasing mode is lower than the paper conveyance speed at which paper is conveyed during an image formation process.

(2) the second fixing temperature set in a fixer in the image erasing mode is higher than that used during an image formation process.

(3) in the image erasing mode, the second conveyance speed set in a conveyance control system is lower than the paper conveyance speed at which paper is conveyed during an image formation process and the second fixing temperature set in a fixer is higher than that used during an image formation process.

In the foregoing embodiments, a thermally erasable toner is used as a thermally erasable recording medium; however, the present invention is not limited to this, thermally erasable ink is also applicable.

In the foregoing embodiments, the counters shown in FIG. 15 carry out a counting operation according to the size of each medium, for example, by considering paper smaller than A4 paper as A4 paper, so as to achieve a counting by category. Thus, the counters shown in FIG. 15 can carry out a counting operation while mastering sizes of mediums.

In the foregoing embodiments, the consumable counter counts up the times a consumable acts, however, the consumable counter may also count up the time a consumable acts. Thus, the consumable counter can carry out a counting operation while mastering the quantity of the motion of the consumable.

In the foregoing embodiments, a print mode is described in contrast to a color erasing mode. Here, the print mode is sometimes referred to as an image formation mode, depending on different image forming apparatuses, thus, the foregoing print mode may also be referred to as an image formation mode.

The functions described in the embodiments above may be achieved by hardware or be recorded in a software program which is then read into a computer to achieve the functions. Further, each function can be achieved by selecting a piece of appropriate software or hardware.

The functions may be achieved by reading a program stored in a recording medium (not shown) into a computer. The recording medium may be of any form as long as the recording medium is capable of storing programs and is readable to a computer.

In addition, the present invention is not limited to the above-described embodiments, and the elements can be embodied in a varied form in the specific implementation.

Furthermore, various inventions can be devised by combining a proper number of the elements disclosed herein. For instance, several of the elements shown in the embodiments may be deleted. Further, the elements involved in different embodiments may be combined in a proper way.

What is claimed is:

1. An image forming apparatus, comprising:

a feed section configured to feed a medium;

an image forming section configured to form an image on the surface of the medium with a thermally erasable recording material or a recording material which is not thermally erasable;

a heating section configured to heat the medium;

a control section configured to conduct a control in a color erasing mode so that the medium, which is stored in the feed section and on which an image is formed with thermally erasable recording material, is subjected to a thermal color erasing processing by the heating section without being subjected to an image forming processing by the image forming section, and to conduct a control in an image formation mode so that the medium stored in the feed section is subjected to an image forming processing by the image forming section and then subjected to an image fixing processing by the heating section;

a color erasing counter configured to count up, according to the size of the medium, the number of the mediums the color of which is thermally erased in the color erasing mode; and a print counter configured to count up, according to the size of the medium, the number of the mediums on which an image is fixed in the image formation mode.

2. The image forming apparatus according to claim 1, comprising:

a consumable counter configured to count up the quantity of the motion of each consumable, wherein the quantity of the motion of the consumable is counted up in the same way in the color erasing mode and the image formation mode.

3. The image forming apparatus according to claim 2, wherein the count value of the quantity of the motion of the consumable in the color erasing mode is obtained by multiplying that obtained in the image formation mode by a correction coefficient.

4. The image forming apparatus according to claim 3, wherein the correction coefficient is a value greater than 0, and the correction coefficient for the consumable in the heating section is a value greater than 1.

5. An image forming method, comprising:

feeding a medium;

forming an image on the surface of the medium with a thermally erasable recording material or a recording material which is not thermally erasable;

heating the medium;

conducting a control in a color erasing mode so that the medium, on which an image is formed with thermally erasable recording material, is subjected to a thermal color erasing processing without being subjected to an image forming processing;

conducting a control in an image formation mode so that an image is formed and fixed on the medium;

counting, according to the size of the medium, the number of the mediums the color of which is thermally erased in the color erasing mode; and counting, according to the size of the medium, the number of the mediums on which an image is fixed in the image formation mode.

* * * * *